US007011169B2

(12) United States Patent
Eason

(10) Patent No.: US 7,011,169 B2
(45) Date of Patent: Mar. 14, 2006

(54) EXPANDED COVERAGE CARBIDE COMPACT

(75) Inventor: Jimmy Wayne Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 110 days.

(21) Appl. No.: 10/704,782

(22) Filed: Nov. 10, 2003

(65) Prior Publication Data

US 2005/0098357 A1 May 12, 2005

(51) Int. Cl.
*E21B 10/16* (2006.01)

(52) U.S. Cl. ..... 175/426; 175/434

(58) Field of Classification Search ..... 175/426, 175/432, 434

See application file for complete search history.

(56) References Cited

U.S. PATENT DOCUMENTS 4,978,173 A * 12/1990 Rothkegel ..... 299/81.1
5,823,277 A 10/1998 Delwiche et al.
5,837,071 A 11/1998 Andersson et al.
6,161,634 A 12/2000 Minikus et al.
6,241,034 B1 6/2001 Steinke et al.
6,367,568 B1 4/2002 Steinke et al.
6,394,199 B1 5/2002 Skyles et al.
2003/0188896 A1 * 10/2003 Minikus et al. ..... 175/374
2004/0163851 A1 * 8/2004 McDonough et al. ..... 175/374

* cited by examiner

*Primary Examiner*—William Neuder
(74) *Attorney, Agent, or Firm*—Bracewell & Giuliani LLP

(57) ABSTRACT

A drill bit with rolling cone cutters for drilling a borehole in an earthen formation. The bit has a bit body, at least one leg depending from the bit body, a rolling cone rotatably mounted on the leg, the cone having a plurality of adjacent rows of cutters thereupon, at least one hole formed within the cone, the hole having a cylindrical wall, and a cutting element partially disposed within the hole, the cutting element having a cylindrical base which fits within the cylindrical wall of said hole, a shoulder which extends outward from the base of the cutting element, and an exposed cutting end extending from the shoulder, the cutting end being substantially symmetrical about a longitudinal axis of the cutting element.

13 Claims, 3 Drawing Sheets

EXPANDED COVERAGE CARBIDE COMPACT

BACKGROUND OF THE INVENTION

1. Field of the Invention

The present invention relates to earth boring drill bits. In particular, the invention relates to an improved geometry for cutting element compacts that are installed in corresponding holes of rolling cone earth boring drill bits.

2. Description of the Related Art

A drill bit fitted with one, two, or three rolling cones may be employed for drilling a borehole by the rotary method in an earthen formation. The drill bit is secured to the lower end of a drill string that is rotated either from the surface or by downhole motors or turbines. The rolling cones are mounted on the drill bit and have cutting elements that contact the interior of the borehole as the drill string is rotated, thereby engaging and disintegrating the earthen formation material. One type of cutting element comprises compacts that are partially disposed within holes in the cones and used to penetrate, gouge and scrape the bottom and sidewalls of the borehole. The cuttings from the borehole are carried in suspension and washed to the surface by drilling fluid that is pumped down from the surface through the hollow, rotating drill string.

When drilling hard and abrasive formations, the life of a drill bit is frequently limited by, among other factors, the wear rate of the compacts in the rolling cones. It is not unusual for the compacts to become worn and lose their ability to effectively cut and penetrate through formations. It is also not unusual for the wear on the compacts to be so severe that the compacts become dislodged after long periods of drilling. In general, worn compacts result in a shorter bit life, and a shorter bit life translates directly into higher well drilling costs, as the entire drill string must be removed from the borehole in order to replace the bit. This process is expensive and requires a substantial amount of time and effort. Thus, it is desired to have a drill bit that can be utilized for longer periods of time and does not need to be replaced as frequently.

It has been previously proposed to extend the life of drill bits by increasing the size of the exposed cutting area of the compact that contacts the formation materials. However, this has typically also involved increasing the size of the entire unexposed area of the compact disposed within the cone cutter surface. An increase in the size of this entire unexposed area results in a decrease in the amount of supporting metal available between the compacts. A minimum amount of supporting metal is required to surround the unexposed portion of each compact to retain the compact within the cone cutter surface.

It has also been previously proposed to reduce the wear on particular compacts by using more compacts in the rolling cones. However, if the rolling cones remain the same size, then adding additional compacts would require that the compacts be spaced more closely together. This has been shown to slow the rate of drill bit penetration and does not fundamentally change the wear characteristics at the compacts. Further, it does not leave adequate supporting metal available between the compacts, and on occasion allows the unexposed portions of the compacts to intermesh or overlap with one another, thus reducing compact retention capability.

A need exists, therefore, for an earth-boring drill bit with compacts and corresponding holes that have an improved geometry that will result in a reduced bit wear rate and increased bit retention during drilling operations.

SUMMARY OF THE INVENTION

The bit of the present invention has a bit body, at least one leg depending from the bit body, a rolling cone rotatably mounted on the leg, the cone having a plurality of adjacent rows of cutters thereupon, at least one hole formed within the cone, the hole having a cylindrical wall, and a cutting element partially disposed within the hole, the cutting element having a cylindrical base which fits within the cylindrical wall of said hole, a shoulder which extends outward from the base of the cutting element, and an exposed cutting end extending from the shoulder, the cutting end being substantially symmetrical about a longitudinal axis of the cutting element.

A feature of the present invention is that the cutting end of the bit includes a portion of a sphere. Another feature is that the shoulder is inclined relative to the longitudinal axis of the cutting element. Another feature is that the hole has a shoulder at an end of the cylindrical wall that mates with the shoulder of the cutting element. Another feature is that the cutting end has a diameter greater than a diameter of the cylindrical wall of the hole. Another feature is that the shoulder of the cutting element is conical and wherein the hole has a conical shoulder at an end of the cylindrical wall that mates with the shoulder of the cutting element. Another feature is that the hole has a bottom and the cutting element has a bottom that is spaced from the bottom of the hole.

In accordance with another aspect of the present invention, an earth boring drill bit may include a bit body, at least one leg depending from the bit body, a generally conical rolling cutter body having an external surface, at least one hole formed in the external surface, the hole having a cylindrical wall and a conical shoulder at an intersection with the external surface, at least one cutting element having a cylindrical base retained in the hole, the cutting element having a conical shoulder that mates with the conical shoulder of the hole and a cutting end that protrudes from the external surface of the cutter body, the cutting end being substantially symmetrical about a longitudinal axis of the cutting element.

A feature of the present invention is that the cutting end comprises a portion of a sphere. Another feature is that the cutting end has a diameter greater than a diameter of the cylindrical wall of the hole. Another feature is that the hole has a bottom and the cutting element has a bottom that is spaced from the bottom of the hole. Another feature is that a junction of the cylindrical base of the cutting element is inwardly spaced by an annular clearance from a junction of the shoulder of the hole and the cylindrical wall In accordance with another aspect of the present invention, an earth boring drill bit may include a bit body, at least one leg depending from the bit body, a generally conical rolling cutter body having an external surface, at least one hole formed in the external surface, the hole having a bottom, a cylindrical wall and a conical shoulder at an intersection with the external surface, at least one cutting element having a cylindrical base retained in the hole, the cutting element having a conical shoulder that mates with the conical shoulder of the hole, a bottom that is spaced from the bottom of the hole, and a cutting end that protrudes from the external surface of the cutter body, the cutting end comprising a portion of a sphere and being substantially symmetrical about a longitudinal axis of the cutting element, and wherein a junction of the cylindrical base of the cutting element is inwardly spaced by an annular clearance from a junction of the shoulder of the hole and the cylindrical wall

BRIEF DESCRIPTION OF THE DRAWINGS

The various aspects of the invention will now be described by way of example only with reference to the accompanying drawings, in which.

DETAILED DESCRIPTION OF THE PREFERRED EMBODIMENT

Figure 1:
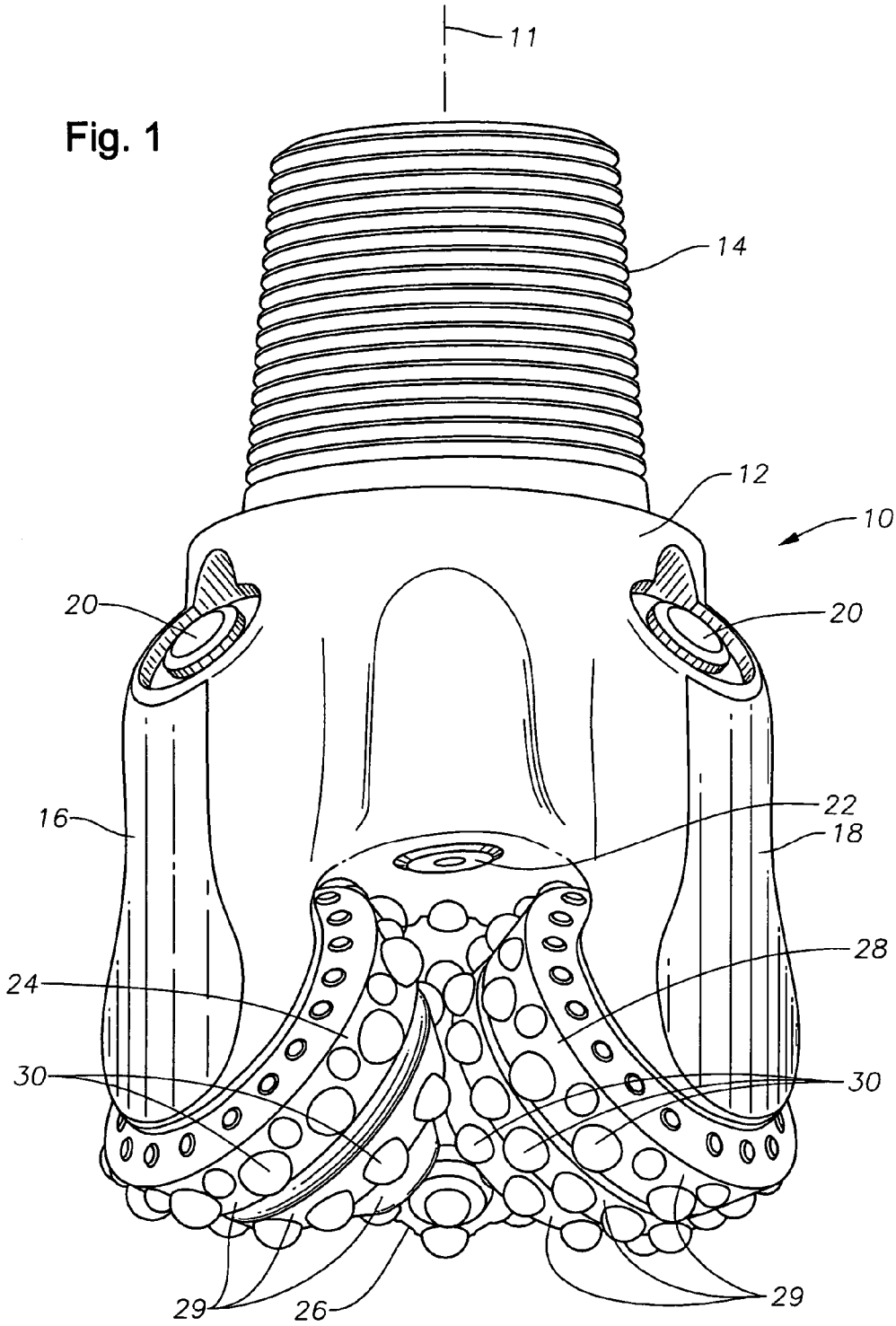
FIG. 1 is a perspective view of an earth-boring bit.

Referring to FIG. 1, an earth boring bit 10 according to the present invention is illustrated. The bit 10 includes a bit body 12 which is threaded at its exposed end 14 for connection with the lower end of a drill string (not shown). The bit body 12 has three downwardly depending legs (two shown at 16, 18) with a lubricant compensator 20 provided for each leg. At least one nozzle 22 is positioned in the bit body to dispense drilling fluid to cool and lubricate the bit 10 during drilling. The drilling fluid is pumped down through the drill string and into a cavity (not shown) in the bit body 12.

A rolling cone cutter is secured to the lower end of each of the three legs of the bit body 12. The three rolling cone cutters 24, 26 and 28 are visible in FIG. 1. Each of the cone cutters includes multiple cutting rows 29. The cutting rows 29 are positioned along the circumference of the cutter, with each cutter having an individual axis of rotation generally oriented downward and inward towards the central axis 11 of the bit 10. Each cutting row 29 includes a plurality of cutting elements or compacts 30 that are partially disposed within the cutting row 29. As each cutter is rotated about its individual axis of rotation, the compacts 30 engage the earth within a borehole and crush it. The compacts 30 are made of a hard, abrasion-resistant material, for example, tungsten carbide. However, other abrasion-resistant materials can be used without deviating from the spirit of the present invention.

Figure 2:
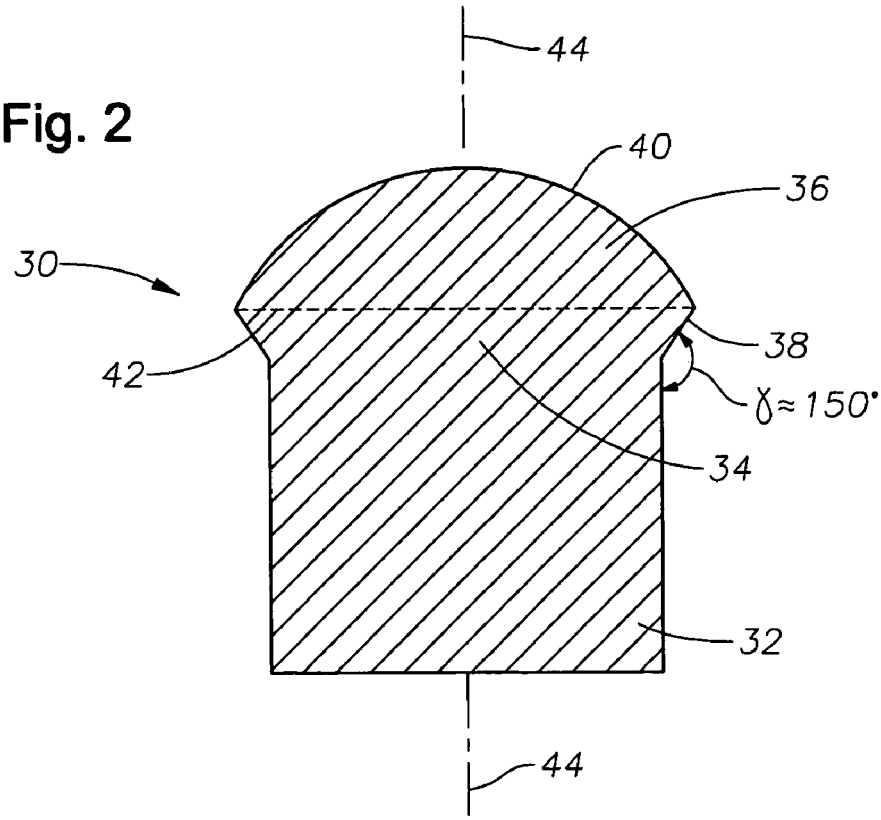
FIG. 2 is a side view of a compact for an earth boring drill bit.

As shown in FIG. 2, the compact 30 of the present invention is generally mushroom shaped and includes a barrel or lower portion 32, a middle portion 34, and an exposed or upper portion 36. The barrel 32 of the compact 30 forms the base of the compact 30 and, in a preferred embodiment, has a generally cylindrical shape. The middle portion 34 of the compact 30 includes a shoulder surface 38 that is generally downward facing and extends outwardly from, and projects beyond, the barrel 32 of the compact 30. In FIG. 2, the shoulder surface 38 is a conical surface oriented at an angle that is approximately 150 degrees from the base of the compact 30. However, it is contemplated that any other angles would be satisfactory. The exposed portion 36 of the compact 30 is convex and has a generally spherically-shaped cutting area 40 in this embodiment. A generally circular outer perimeter 42 for the exposed portion 36 of the compact 30 is defined by the points where the exposed cutting area 40 converge with, and meet, the ends of the outwardly extending shoulder surface 38 of the compact 30. Exposed portion 36 is symmetrical about a longitudinal axis of revolution in this embodiment; however, other shapes are feasible.

Figure 3:
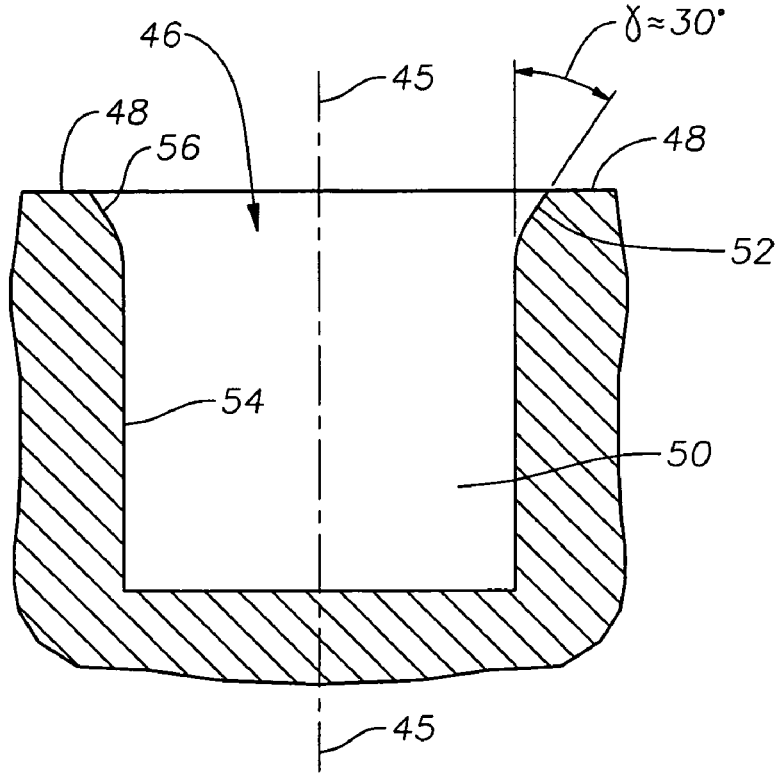
FIG. 3 is a sectional view of a hole located in a rolling cone cutter for an earth boring drill bit.

FIG. 3 shows a hole 46 that has been drilled or otherwise formed into the surface 48 of one of the rolling cone cutter rows 29. The hole 46 has a barrel 50 and an exposed portion 52. The barrel 50 of the hole 46 has cylindrical interior walls 54. The exposed portion 52 of the hole 46 has a conical shoulder surface 56 that is generally upward facing and extends outwardly from the cylindrical interior walls 54. In FIG. 3, the shoulder surface 56 is oriented at an angle that is approximately 30 degrees relative to a longitudinal axis of hole 46. However, it is contemplated that other angles are feasible. In all locations, the width of the exposed portion 52 of the hole 46, when measured by a line that passes through the longitudinal axis of the hole 45, will be larger than the width of the barrel 50 of the hole 46.

Figure 4:
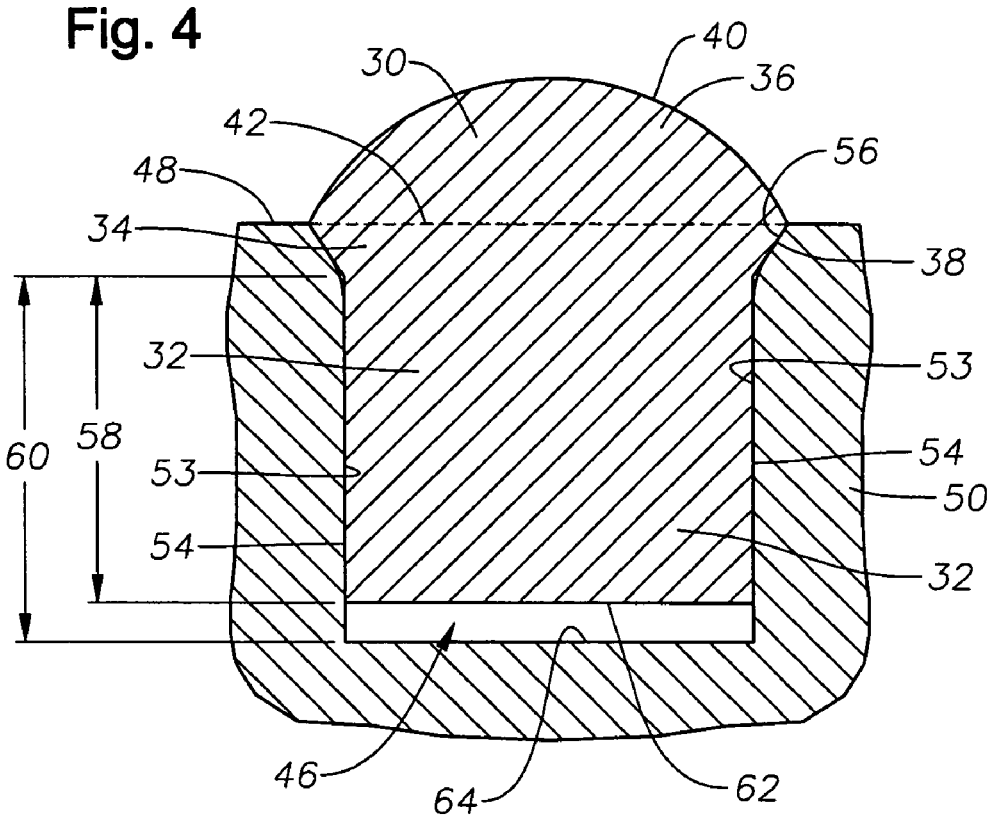
FIG. 4 is a sectional view of a compact disposed within a hole of a rolling cone cutter.

During assembly of the drill bit, as shown in FIG. 4, the compact 30 of the present invention is disposed within the hole 46 in the rolling cone cutter surface 48. The compact 30 is secured by press-fitting or some other securing means. Preferably, the outer diameter of barrel 32 of compact 30 is slightly larger than the inner diameter of hole portion 50, creating an interference fit. The shoulder surface 38 of the compact 30 is adapted to engage and sit against the shoulder surface 56 of the hole 46 in a noninterference-fit.

The exposed cutting area 40 on the exposed portion 36 of the compact 30 is raised above the cone cutter surface 48 and protrudes from the hole 46. In the embodiment shown in FIG. 4, the outer perimeter 42 of the exposed portion 36 of the compact 30, i.e., the points where the exposed cutting area 40 converge with, and meet, the ends of the outwardly extending shoulder surface 38 of the compact 30, is adjacent to and flush with the cone cutter surface 48. In an alternative embodiment, the outer perimeter 42 can overlap and/or sit upon the cone cutter surface 48.

The diameter of the compact 30 at its outer perimeter 42 is greater than the diameter of the barrel 50 of the hole 46. The length 58 of the barrel 32 of the compact 30 is less than or equal to the depth 60 of the barrel 50 of the hole 46. Thus, in the embodiment shown in FIG. 4, when the compact 30 is disposed within the hole 46, the bottom surface 62 of the barrel 32 of the compact 30 is generally parallel to, but does not contact, the bottom 64 of hole 46, thus leaving a gap between the compact 30 and the bottom 64 of hole 46. This gap is to ensure that the interference and noninterference fits at the locations between the walls of the compact 30 and the hole 46, as herein described, are achieved.

Figure 5:
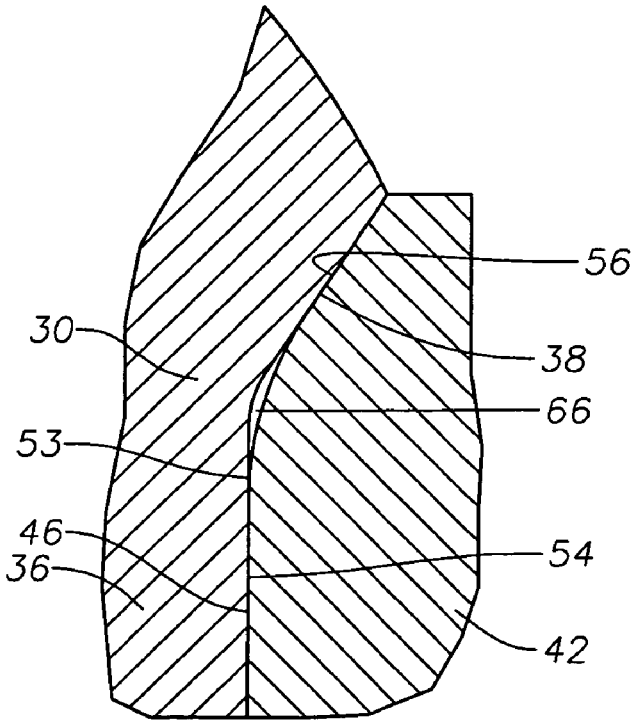
FIG. 5 is a side sectional view of an opening between a compact and a hole of a rolling cone cutter.

As is more clearly depicted in FIG. 5, a clearance 66 is shown between the wall 53 of compact 30 and the annular interior wall 54 of the hole 46. This clearance 66 is located near the junction between the barrel 32 and the middle portion 34 of the compact, between the section where the interference-fit of the barrel 36 of the compact 30 and the barrel 42 of the hole 46 ends, and the section where the non-interference fit of the shoulder surface 38 of the compact 30 and the shoulder surface 56 of the hole 46 begins. The purpose of this clearance 66 is to reduce the stress at this location caused by, for example, expansion due to heat.

During drilling, the exposed cutting area 40 of the compact 30 is used to penetrate and gouge the bottom of the borehole. The bit 10 is operated so that the compacts 30 in the rolling cone cutters 24, 26 and 28 are maintained in crushing contact with portions of the surrounding borehole. After a substantial amount of operation, the bit 10 will experience wear. However, as a result of the outwardly extending shoulder surface 38 at the middle portion 38 of the compact 30, the width of the exposed cutting area 40 of the compact 30 is increased. This results in a larger surface area of cutting material that is available for exposure to the formation within the borehole, thus providing enhanced capability for penetrating and gouging within the borehole. The larger exposed cutting area advantageously results in a reduced bit wear rate during drilling operations when compared to compacts shown in the prior art.

The present invention is also advantageous in that it provides improved lifespan before the compacts become completely worn or destroyed. This will extend the useful life of a drill bit and allow it to complete a section of borehole without having to be so quickly replaced, resulting in increased and more efficient production rates and decreased drilling costs. Also, because the size of the barrel of the hole has not been increased and remains at a size where it does not cause unnecessary intermeshing or overlapping of compacts, there is no need for reduction of the amount of metal surrounding and supporting the barrel of the compacts.

Further, the exposed cutting area and its perimeter are symmetrical around the longitudinal axis of the base of the compact as well as the longitudinal axis of the hole, which provides for more uniform and precise penetrating and gouging.

While the invention has been described herein with respect to a preferred embodiment, it should be understood by those that are skilled in the art that it is not so limited. The invention is susceptible of various modifications and changes without departing from the scope of the claims.

What is claimed is:

1. A bit for use in drilling a borehole, the bit comprising:

a bit body;

at least one leg depending from the bit body;

a rolling cone rotatably mounted on the leg, the cone having a plurality of adjacent rows of cutters thereupon;

at least one hole formed within the cone, the hole having a cylindrical wall encircled by a shoulder formed at an end thereof; and a cutting element partially disposed within the hole, the cutting element having a cylindrical base which fits within the cylindrical wall of said hole, a circular shoulder which extends outward from the base of the cutting element and mates with the shoulder encircling the cylindrical wall, and an exposed cutting end extending from the shoulder.

2. A bit for use in drilling a borehole, the bit comprising:

a bit body;

at least one leg depending from the bit body;

a rolling cone rotatably mounted on the leg, the cone having a plurality of adjacent rows of cutters thereupon;

at least one hole formed within the cone, the hole having a cylindrical wall with a shoulder formed at the end thereof; and a cutting element partially disposed within the hole, the cutting element having a cylindrical base which fits within the cylindrical wall of the hole, a shoulder which extends outward from the base of the cutting element and mates with the shoulder of the hole and an exposed cutting end extending from the shoulder of the cutting element.

3. The bit of claim 2, wherein the cutting end has a diameter greater than a diameter of the cylindrical wall of the hole.

4. The bit of claim 2, wherein the shoulder of the cutting element is conical and wherein the shoulder of the hole is conical.

5. The bit of claim 2, wherein the cutting end comprises a portion of a sphere.

6. The bit of claim 2, wherein the shoulder of the cutting element is inclined relative to the longitudinal axis of the cutting element.

7. A bit for use in drilling a borehole, the bit comprising:

a bit body;

at least one leg depending from the bit body;

a rolling cone rotatably mounted on the leg, the cone having a plurality of adjacent rows of cutters thereupon;

at least one hole formed within the cone, the hole having a cylindrical wall and a bottom; and a cutting element partially disposed within the hole, the cutting element having a cylindrical base which fits within the cylindrical wall of the hole and a bottom that is spaced from the bottom of the hole, a shoulder which extends outward from the base of the cutting element and an exposed cutting end extending from the shoulder.

8. An earth boring drill bit comprising:

a bit body;

at least one leg depending from the bit body;

a generally conical rolling cutter body having an external surface;

at least one hole formed in the external surface, the hole having a cylindrical wall and a conical shoulder at an intersection with the external surface;

at least one cutting element having a cylindrical base retained in the hole, the cutting element having a conical shoulder that mates with the conical shoulder of the hole and a cutting end that protrudes from the external surface of the cutter body, the cutting end being substantially symmetrical about a longitudinal axis of the cutting element.

9. The cutting element of claim 8, wherein the cutting end comprises a portion of a sphere.

10. The bit of claim 8, wherein the cutting end has a diameter greater than a diameter of the cylindrical wall of the hole.

11. The bit of claim 8, wherein the hole has a bottom and the cutting element has a bottom that is spaced from the bottom of the hole.

12. The bit of claim 8, wherein a junction of the cylindrical base of the cutting element is inwardly spaced by an annular clearance from a junction of the shoulder of the hole and the cylindrical wall.

13. An earth boring drill bit comprising:

a bit body;

at least one leg depending from the bit body;

a generally conical rolling cutter body having an external surface;

at least one hole formed in the external surface, the hole having a bottom, a cylindrical wall and a conical shoulder at an intersection with the external surface; and at least one cutting element having a cylindrical base retained in the hole, the cutting element having a conical shoulder that mates with the conical shoulder of the hole, a bottom that is spaced from the bottom of the hole, and a cutting end that protrudes from the external surface of the cutter body, the cutting end comprising a portion of a sphere and being substantially symmetrical about a longitudinal axis of the cutting element, and wherein a junction of the cylindrical base of the cutting element is inwardly spaced by an annular clearance from a junction of the shoulder of the hole and the cylindrical wall.

* * * * *